US009919320B2

(12) United States Patent
Jameson

(10) Patent No.: US 9,919,320 B2
(45) **Date of Patent: *Mar. 20, 2018**

(54) METHOD AND APPARATUS FOR CONTACTING BUBBLES AND PARTICLES IN A FLOTATION SEPARATION SYSTEM

(71) Applicant: The University of Newcastle Research Associates Limited, Callaghan (AU)

(72) Inventor: Graeme J. Jameson, Callaghan (AU)

(73) Assignee: THE UNIVERSITY OF NEWCASTLE RESEARCH ASSOCIATES LIMITED, Callaghan (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/487,648

(22) Filed: Apr. 14, 2017

(65) Prior Publication Data

US 2017/0216850 A1 Aug. 3, 2017

Related U.S. Application Data

(63) Continuation of application No. 13/974,846, filed on Aug. 23, 2013, now Pat. No. 9,656,273, which is a (Continued)

(30) Foreign Application Priority Data

Feb. 1, 2005 (AU) ..... 2005900409
Jul. 5, 2005 (AU) ..... 2005903542

(51) Int. Cl.

*B03D 1/24* (2006.01)
*B03D 1/14* (2006.01)
*B03D 1/26* (2006.01)

(52) U.S. Cl.

CPC ..... *B03D 1/247* (2013.01); *B03D 1/1456* (2013.01); *B03D 1/1493* (2013.01); *B03D 1/26* (2013.01)

(58) Field of Classification Search

CPC ..... B03D 1/02; B03D 1/247; B03D 1/1493; B03D 1/26

See application file for complete search history.

(56) References Cited

U.S. PATENT DOCUMENTS 3,371,779 A 3/1968 Hollingsworth et al.
3,791,104 A 2/1974 Clitheroe
(Continued)

FOREIGN PATENT DOCUMENTS

AT 342 528 8/1977
CA 2106925 A1 3/1994
(Continued)

OTHER PUBLICATIONS

International Search Report for International Application No. PCT/AU2006/000123 dated Mar. 2, 2006.
(Continued)

*Primary Examiner* — Thomas M Lithgow
(74) *Attorney, Agent, or Firm* — Marshall, Gerstein & Borun LLP

(57) ABSTRACT

A flotation separation apparatus for separating particles in suspensions, feeds slurry containing the particles through an inlet into a contactor where gas is fed through an inlet to mix with the slurry, for example in a downwardly plunging jet, to form a gas-liquid bubbly two-phase mixture under pressure from an outlet restriction in a throttling duct. The mixture is passed through a flow manipulator configured to induce a high energy dissipation rate, for example by way of a Shockwave formed in a diverging section of the throttling duct reducing the size of the bubbles and brining those
(Continued)

bubbles into intimate contact with particles in the mixture which is released into a separation cell where a flow manipulating draft tube is provided to reduce turbulence in the mixture. Alternative apparatus and methods for inducing the high energy dissipation rate and for reducing turbulence in the mixture are also described and claimed.

13 Claims, 10 Drawing Sheets

Related U.S. Application Data continuation of application No. 11/815,202, filed as application No. PCT/AU2006/000123 on Feb. 1, 2006, now abandoned.

(56) References Cited

U.S. PATENT DOCUMENTS

| | | | |
|---|---|---|---|
| 4,110,210 | A | 8/1978 | Degner et al. |
| 4,448,681 | A | 5/1984 | Ludke et al. |
| 4,472,271 | A | 9/1984 | Bacon, Jr. |
| 4,477,341 | A | 10/1984 | Schweiss et al. |
| 4,617,113 | A | 10/1986 | Christophersen et al. |
| 4,752,383 | A | 6/1988 | McKay et al. |
| 4,911,826 | A | 3/1990 | Harach et al. |
| 4,938,865 | A | 7/1990 | Jameson |
| 5,154,351 | A | 10/1992 | Takko |
| 5,332,100 | A | 7/1994 | Jameson |
| 5,397,001 | A | 3/1995 | Yoon et al. |
| 5,525,238 | A | 6/1996 | Menke |
| 9,656,273 | B2 * | 5/2017 | Jameson ..... B03D 1/02 |
| 2001/0025808 | A1 | 10/2001 | Scherzinger et al. |
| 2001/0032812 | A1 | 10/2001 | Morse et al. |

FOREIGN PATENT DOCUMENTS

| | | | |
|---|---|---|---|
| DE | 24 20 482 | | 11/1975 |
| DE | 198 31 530 | C1 | 3/2000 |
| DE | 199 15 735 | A1 | 10/2000 |
| EP | 1 084 753 | | 3/2001 |
| GB | 1 512 565 | | 6/1978 |
| WO | WO-1996/028254 | A1 | 9/1996 |
| WO | WO-2000/015343 | A1 | 3/2000 |

OTHER PUBLICATIONS

International Preliminary Report on Patentability for International Application No. PCT/AU2006/000123 dated May 3, 2007.

Written Opinion for International Application No. PCT/AU2006/000123 dated Jun. 11, 2008.

Office Action in CA Application No. 2,596,329 dated Mar. 27, 2013.

Ahmed et al., "The Effect of Bubble Size on the Rate of Flotation of Fine Particles", International Journal of Mineral Processing, 14, 1985, pp. 195-215.

Finch et al., "Column Flotation", Flotation Science and Engineering, (K.A. Matis, ed.), Marcel Dekker, N.Y., 1995, pp. 291-331.

Finch et al., "Column Flotation," Pergamon Press, 1990, entire book submitted (180 pages).

* cited by examiner

METHOD AND APPARATUS FOR CONTACTING BUBBLES AND PARTICLES IN A FLOTATION SEPARATION SYSTEM

RELATED APPLICATIONS

This is a continuation application which is based on, and claiming priority to, U.S. application Ser. No. 13/974,846 entitled "Method And Apparatus For Contacting Bubbles And Particles In A Flotation Separation System," filed Aug. 23, 2013, which, in turn, is a continuation application based on, and claiming priority to, U.S. application Ser. No. 11/815,202 entitled "Method And Apparatus For Contacting Bubbles And Particles In A Flotation Separation System," filed Jul. 31, 2007, which, in turn, is a national stage filing of PCT/AU2006/000123 filed on Feb. 1, 2006, which, in turn, claims priority benefit under 35 USC §119 of Australian patent application number 2005900409, filed on Feb. 1, 2005, and of Australian patent application number 2005903542, filed on Jul. 5, 2005, the entire disclosures of which are hereby incorporated by reference herein in their entirety.

FIELD OF THE INVENTION

This invention relates to the froth flotation process for the recovery or separation of particles from suspensions in liquids in general, and more particularly to an efficient contacting apparatus and process for use in flotation separation systems.

BACKGROUND

The flotation process is used in the separation of particles from mixtures in a finely divided state, suspended in a liquid. For example, in the minerals industry, a suspension of solid particles in water is treated with chemical reagents or collectors which have the effect of making the particles which it is desired to remove, water repellent or hydrophobic, while leaving the remaining particles in a wetted or hydrophilic state. The liquid is fed into a flotation separation cell, which may be in the form of a tank or column, and air is injected in the form of fine bubbles. The hydrophobic particles attach to the air bubbles and rise to the surface of the cell, from which they can be removed by flowing over a lip under the action of gravity, into a launder or channel. The particles which are not collected by the bubbles remain in the suspension and flow out of the bottom of the cell, in the tailings. Frother reagents are often added to the feed liquid in order to assist in the formation of a stable froth on top of the liquid in the cell. Clean water may be applied to the froth layer in order to wash entrained particles downwards into the cell.

Flotation is also used generally for the recovery of fine particles from suspensions in liquids, as in the removal of printing ink from recycled paper; for the removal of particles especially fat and oil droplets from waste waters in the food industry; for removal of particulates in processes for the remediation of contaminated sites; for the treatment of produced water emanating from oil fields; and for the recovery of algae and other organisms from suspensions in fresh water or sea water. For purposes of description, the term 'air' may be used to represent the gas, 'water' may be used to represent the liquid and the floatable component may be referred to as 'particles' or in some cases as the 'values'. The non-floating component is referred to as 'gangue'. It is to be understood however that the same principles apply in other systems involving fine particles that are not minerals, dispersed in aqueous or non-aqueous media, being floated with gases other than air.

In earlier technology, flotation has been carried out in mechanical cells in which the liquid is agitated by a rotating impeller and air is introduced in the vicinity of the impeller. The bubble sizes produced in these devices are not necessarily small, being typically in the range 1 to 5 mm in diameter. More recently, flotation has come to be carried out in columns, which have operational advantages in being able to provide better control of the phenomena in the froth. Flotation columns in current use, vary in the aspect ratio. Some are tall relative to their diameter or breadth, with a height-to-diameter ratio of at least 2:1 and up to 10:1 or greater. In these devices the feed slurry is typically injected towards the top of the column, and a stream of bubbles is created by a suitable means such as a sparger, injector, aspirator, nozzle or bubble generator. The objective of these aeration devices is to distribute the bubbles essentially uniformly across the cross-section of the column. Thus as the stream of particle-laden liquid descends down the column, it meets a distributed cloud of small bubbles rising vertically. The individual bubbles collide with and capture the hydrophobic values, and carry them upwards into the froth.

Any discussion of the prior art throughout the specification should in no way be considered as an admission that such prior art is widely known or forms part of common general knowledge in the field.

In both mechanical cells and columns, the contact between bubbles and particles usually takes place in the liquid in the vessel itself. Thus the reason for the height of tall column cells, is to provide sufficient time for the bubbles to come into contact with particles as they rise in the column. Flotation column cells as described particularly by Finch and Dobby (Column Flotation, Pergamon Press, Oxford, England, 1990), consist of three zones: the froth zone at the very top of the column, typically 1 m in height; the collection zone, where bubble-particle contact occurs, typically 5 to 10 m in height; and the disengagement zone in the base of the column, where the liquid flows out of the column, typically 1 to 2 m in height. Thus the overall height of a column cell is in the range 7 to 13 m. The froth zone must be of sufficient height to allow the gangue particles to drain, and clean wash water is often distributed over the top of the froth or within the froth, to wash the gangue back into the liquid in the flotation cell. The disengagement zone is a quiescent location, where the downward velocity of the liquid is less than the rise velocity of the bubbles which have been introduced higher in the cell, so that the bubbles are able to escape from the exit stream from the column.

Internal bubble generators are known for flotation columns. Some consist of simple distributor pipes with small holes in the walls, or with porous walls. In others, such as the generator of Harach, U.S. Pat. No. 4,911,826, an array of fine nozzles is supported by distributor pipes across the whole cross-section of a tall column. Air and water streams are supplied through headers, and a mixture of air and water is discharged through each fine nozzle. In yet others, air under pressure is supplied to tubes made of an elastic material like rubber. The surface of the elastic tubes is pierced with an array of very fine holes which remain closed when the external pressure is greater than the pressure within the tube. As the internal pressure is increased, the elastic wall stretches and the fine holes enlarge sufficiently to allow the passage of air, which is discharged from the holes in the form of fine air bubbles.

External bubble generators are also known in the tall flotation column cells. Hollingsworth, U.S. Pat. No. 3,371,779, describes a venturi-type aspirator to produce air bubbles into a stream of fresh water which is then introduced into the bottom of a flotation column. Christopherson, U.S. Pat. No. 4,617,113, described how a multitude of venturi aerators can be distributed around a large column. Air is inspired into water flowing through the venturis. In the apparatus of McKay and Foot, U.S. Pat. No. 4,752,383, air and water are premixed at high pressures in a chamber containing beads. The aerated water is then injected into the base of a flotation column through a lance, which has a small orifice at the end. Bacon, U.S. Pat. No. 4,472,271, produced bubbles in slurry taken from the bottom of the flotation cell. The bubbles were made by passing air and slurry through a nozzle. The bubble-laden slurry stream was reintroduced through the wall of the flotation column. Yoon, U.S. Pat. No. 5,397,001, has described a flotation column in which the air is dispersed into slurry in external static mixers. Slurry is taken out of the bottom of the flotation cell and distributed equally among a number of static bubble generators where air is added. The aerated slurry stream is then injected into the flotation column above the external aerators. In the aforementioned devices, the external devices are essentially bubble generators and contact takes place within the column.

Short columns are known, in which the height and diameter are of the same order of magnitude, and the height-diameter ratio in industrial applications may be from 0.2 to 1, to 2 to 1. In these short columns, air is introduced into the feed liquid in an aeration system prior to injection into the column, and it is in this aeration system that contact between bubbles and particles is established. Relatively little contact is effected in the column proper. The aeration system may take the form of a plunging jet, a venturi, a static mixer, or a sparger or porous-walled pipe through which air is introduced in a turbulent fashion into the feed slurry. Examples of such devices are described by Jameson, U.S. Pat. No. 4,938,865; and U.S. Pat. No. 5,332,100; Bahr, Ger. Pat. No. 2,420,482; Imhof, Europ. Pat. No. 1,084,753, and Ludke, U.S. Pat. No. 4,448,681. Because of the high-efficiency contacting in the aeration device, the functions required in the flotation column or tank are much reduced. Thus in principle, there is no need for the collection zone as found in tall column cells, because bubbles and particles have already contacted each other. However, the froth and disengagement zones are required. For present purposes, short flotation column cells of the types described by Jameson and Bahr will be referred to as "intensive" cells. Because there is no need for the collection zone, the intensive cells have significant advantages over the tall column cells, emanating from the much reduced size.

All of the aforementioned inventions describe processes to disperse air bubbles into a liquid which may or not contain suspended particles. However, none of these bubble-generating devices place any form of flow restriction that can be used to control or influence the pressure in the air-liquid mixture after formation. It can be advantageous to control the pressure at which the bubbles are formed, both in absolute terms and also in terms relative to the pressure at which they are to be used in the flotation vessel. For example, when bubbles are generated by the breakup of a supply of air in a shear flow such as exists in the throat of a venturi, or in a static mixer, the size of the resulting bubbles is a function of the local void fraction, which is the ratio of the volume of gas under local pressure conditions, to the total volume of gas and liquid. It is generally desirable to minimize coalescence of bubbles after formation, because it is well known that the rate of capture of particles by bubbles diminishes as the bubble size increases, for a constant air/liquid ratio. Bubble swarms that are created in a gas-liquid mixture of low void fraction, are generally more stable, because the rate of coalescence of bubbles is related to the mean distance between the bubbles, which in turn is related to the void fraction. For the same mass ratio of gas to liquid, the volume ratio varies inversely as the absolute pressure. Thus if it is desired to supply a feed liquid with an equal volume of air at the absolute pressure in the flotation cell, it will be advantageous to create the bubbles at a higher pressure than exists in the cell. For example, if the absolute pressure at which bubbles are generated is twice the absolute pressure in the cell, the volume fraction will be one half that in the cell.

This effect was recognised by Amelunxen (CA Patent Specification 2106925), who described an external contactor, a throttle valve for controlling the process pressure within the contactor and a system for injecting air and liquid into the contactor under pressure.

All of the prior art contactors suffer from disadvantages, which can variously relate to: limitations in the amount of air that can be supplied relative to the amount of liquid flowing through the sparger or aeration device; the necessity for small orifices or tubes which readily corrode or become blocked by the particles present in the feed; the necessity for complex and expensive manufacturing processes to provide parts that can withstand the wear associated by high velocity flows; the difficulty of replacing crucial wearing parts in an operating plant; the need for relatively high concentrations of frother or other expensive surface active agent in order to produce small bubbles; high operating costs associated with excessive driving pressures in the liquid and/or the air streams.

There is a range of particle sizes in the feed suspension for which current flotation technologies are efficient. Thus in an intermediate particle size range, between 40 and 150 microns for minerals (and 75 and 350 microns for coal), conventional flotation cells can achieve high recoveries. However, when the size of the particles is less than or greater than the intermediate range, the flotation recovery tends to decrease as the particles become smaller (or larger). For present purposes, "fine" particles are those whose diameter is smaller than the appropriate intermediate size range, i.e. those between 0 and 40 microns for minerals, and 0 and 75 microns for coal; "ultrafine" particles are those at the lower end of the "fine" range; and "coarse" particles are those whose diameter is greater than 150 microns for minerals, and 350 microns for coal.

The inventor of the present invention has found that improved flotation of fine particles can be achieved by reducing the bubble size, increasing the gas supply rate relative to the flow rate of particles, and increasing the shear intensity or energy dissipation rate in or adjacent the contacting device. The rate of recovery is related to the rate at which the particles collide with the bubbles. Since the inertia of the particles varies inversely as the cube of the diameter, as the particles become smaller, so finer particles tend to follow the fluid streamlines around the bubbles and the probability of attachment is reduced as the size decreases. The recovery of fine particles can be improved by using smaller bubbles and by increasing the rate of shear in the contacting system (N Ahmed and G J Jameson, "The effect of bubble size on the rate of flotation of fine particles", Int. J. Mineral Processing, 14, (1985), 195-215.). A substantial improvement in the performance of a typical flotation machine can be expected if the bubble size is reduced. Accordingly, it has been recognised by the inventor that for high-efficiency flotation a source of fine bubbles, typically in the range 400 microns in diameter or smaller, be provided, in a high-energy dissipation rate environment.

For coarse particles, the reduction in recovery as the particle size increases is due to the inability of bubbles and hydrophobic particles to stay in contact with each other in a highly-turbulent environment. The bubbles tend to move to the centre of vortices or eddies in the flotation cell and the particles are flung away from the bubbles by centrifugal forces. High recoveries of coarse particles are favoured by a high gas fraction in the slurry suspension, by low levels of turbulence in the region below the froth layer. It is also favourable to provide a means to levitate the coarse particles so that their upwards passage towards the froth is assisted by an upwards motion of liquid in the region beneath the froth.

It is the purpose of the present invention to provide simple, efficient and economic means to overcome the difficulties and inefficiencies in known flotation technologies, by generating fine bubbles and bringing them into contact with the particles to be floated, and controlling the resulting gas-solid-liquid mixture so as to maximise the transfer of hydrophobic particles into the froth and hence into the flotation product.

SUMMARY

In one aspect, the present invention provides an apparatus for contacting bubbles and particles in a flotation separation system, said apparatus including;

a contactor arranged to receive under pressure a supply of feed slurry incorporating particles suspended in a liquid and a supply of gas, the contactor being arranged to mix the slurry with the air forming a gas-liquid bubbly two-phase mixture;

an outlet from the contactor configured to provide a restriction to the flow of mixture therethrough and maintain the mixture within the contactor under pressure;

a flow manipulator downstream from the outlet configured to induce a high energy dissipation rate within the mixture passing therethrough; and a separation cell arranged to receive mixture from the flow manipulator and allow bubbles with attached particles to rise to the surface of liquid within the cell.

Preferably the separation cell is provided with a mixture directing device arranged to receive the mixture from the flow manipulator and control the release of that mixture into the cell.

Preferably the contactor includes a substantially vertical column arranged to receive the feed slurry under pressure into the top of the column.

Preferably the contactor incorporates mixing means including a nozzle arranged to form a downwardly plunging jet of feed slurry within the column, and a gas inlet in the vicinity of the jet so formed such that in use gas is entrained into the jet forming said gas-liquid bubbly two-phase mixture.

Preferably the outlet from the contactor is configured to form at least one throttling duct providing said restriction to the flow of mixture therethrough.

Preferably the throttling duct has a converging section leading to a throat sized to provide said restriction.

In one form of the invention the flow manipulator includes a diverging section immediately downstream of the throttling duct, configured to induce a shock wave in the mixture passing through the diverging section in use and provide said high energy dissipation rate.

In another form of the invention the throttling duct is arranged to open abruptly into a conduit extending within the separation cell, said conduit having one or more openings in the separation cell adjacent the throttling duct through which liquid is entrained in use from the separation cell into the conduit.

Preferably the throttling duct and conduit are configured such that under desired operating conditions a shock wave is formed downstream of the throttling duct providing said high energy dissipation rate in the vicinity of the openings in the conduit.

In one configuration of the apparatus according to the invention the column is located with its lower end within the separation cell, and wherein a plurality of said throttling ducts are provided orientated radially outwardly adjacent the lower end of the column.

In another configuration the column is located with its lower end within the separation cell, and wherein the throttling duct is orientated substantially downwardly at the lower end of the column and provided with an impingement plate positioned substantially horizontally below the throttling duct, spaced therefrom so as to provide said flow manipulator inducing said high energy dissipation rate within the mixture passing therethrough.

Preferably the impingement plate comprises a lower circular disc aligned with and spaced from an upper circular disc having a central hole therethrough arranged to receive mixture issuing from the throttling duct, such that in combination with the diameter of the discs and the operating pressure and velocity within the throttling duct, sonic flow conditions exist in use in or downstream of the throat in the throttling duct.

In one form of the invention the lower disc is spaced a fixed distance from the upper disc, said distance being determined to provide said sonic flow conditions.

In another form the lower disc is free to move in a vertical direction relative to the upper disc, allowing the lower disc to come to a stable equilibrium in use, forming said sonic flow conditions.

In another form at least one of the upper and lower discs is flexible and able to adapt to a shape dictated by pressure developed in the flow between the discs in use.

Preferably the lower plate is flexible and wherein the lower plate is provided with a central solid wear resistant zone located a fixed distance below the outlet from the throttling duct.

Preferably the mixture directing device comprises a draft tube in the form of a substantially vertical shroud located within the separation cell and arranged to direct the flow of mixture from the flow manipulator into the separation cell.

In one form the shroud is open at both the upper and lower ends and positioned to induce flow of liquid therethrough in a generally upward direction in use such that liquid within the lower part of the separation cell is induced to flow upwardly through the shroud, joining the mixture issuing into the shroud from the flow manipulator.

Preferably the lower end of the shroud is restricted in size to control the flow rate of liquid passing into the shroud from the separation cell.

In one form the shroud is substantially constant in cross-section over the majority of its length.

In another form the shroud is tapered outwardly and upwardly having a greater opening at the upper end than the lower end.

In yet another embodiment of the invention the shroud has a closed lower end.

Preferably the impingement plate is located at the closed lower end of the shroud.

Preferably the relationship between the throttling duct, the impingement plate and the shroud is such as to form said flow manipulator causing a rapidly rotating toroidal vortex within the lower end of the shroud and inducing said high energy dissipation rate within the mixture.

Preferably the relationship between the throttling duct, the impingement plate and the shroud is such as to form an expanded fluidized bed within the shroud when the apparatus is operated at desired parameters.

In a further aspect, the present invention provides a method of contacting bubbles and particles in a flotation separation system, said method including the steps of:

providing apparatus including: a contactor arranged to receive under pressure a supply of feed slurry incorporating particles suspended in a liquid and a supply of gas, mixing means within the contactor arranged to mix the slurry with the air forming a gas-liquid bubbly two-phase mixture, an outlet from the contactor configured to provide a restriction to the flow of mixture therethrough and maintain the mixture within the contactor under pressure, a flow manipulator downstream from the outlet configured to induce a high energy dissipation rate within the mixture passing therethrough, and a separation cell arranged to receive mixture from the flow manipulator and allow bubbles with attached particles to rise to the surface of liquid within the cell;

and feeding slurry and gas into the contactor at feed rates and pressures determined to form said gas-liquid bubbly two-phase mixture and force the mixture through said flow manipulator at a rate that induces said high energy dissipation rate within the mixture reducing the size of the bubbles within the mixture and bringing those bubbles into intimate contact with particles in the mixture.

Preferably the method includes the step of feeding the mixture from the flow manipulator into a mixture directing device within the separation cell.

Preferably the mixture is fed into the mixture directing device in a manner that, in combination with the shape of the mixture directing device, reduces turbulence within the mixture.

In one form the mixture directing device is a draft tube in the form of a substantially vertical shroud arranged to direct the flow of mixture upwardly into the separation cell.

Preferably the slurry is conditioned with collectors and frother reagents prior to being fed into the contactor.

Preferably the collectors and frother reagents are selected to render the particles hydrophobic and able to form strong bonds with the bubbles.

In one use of the method the particles comprise minerals and the flotation separation system is operated to separate the minerals from gangue or other contaminants. A typical example is the separation of coal particles from gangue.

In an alternative use of the method the feed slurry contains particles of an organic nature and the flotation separation system is operated to remove those particles from the liquid.

In yet another use the particles are metal particles such as aluminium particles.

BRIEF DESCRIPTION OF THE DRAWINGS

FIG. 5(*b*) is an enlarged plan view in the plane A-A in FIG. 4 showing the disposition of the flow restrictions shown in FIG. 4 and FIG. 5(*a*);

FIG. 6(*b*) is an enlarged plan view of the restriction and radial flow device shown in FIG. 6(*a*);

DETAILED DESCRIPTION

Figure 1:
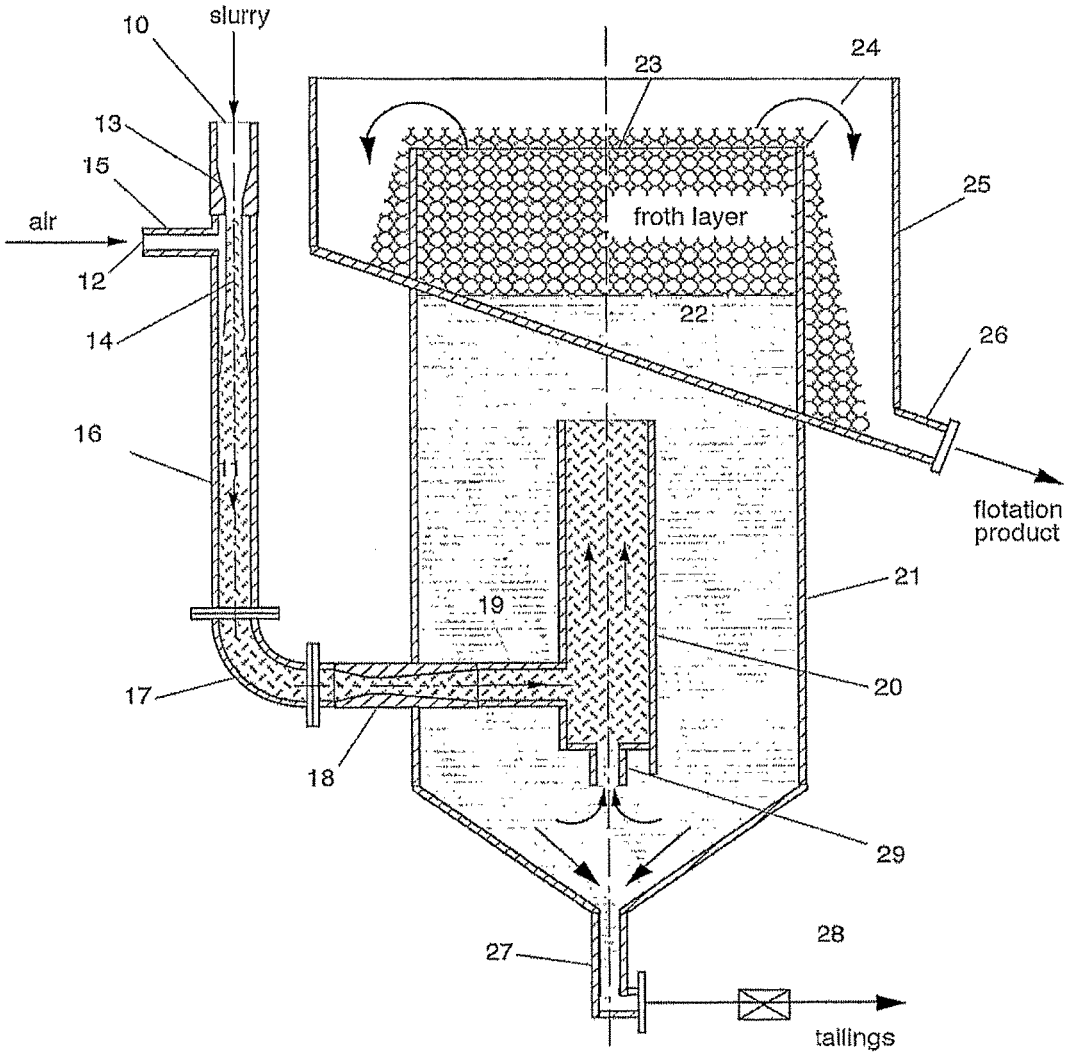
FIG. 1 is a schematic side view of a flotation device showing a gas-liquid contactor, a flow restrictor and a riser pipe to direct the flow downstream of the restrictor according to the present invention.

A first preferred embodiment of an intensive flotation column flotation cell according to the invention is shown in FIG. 1. The liquid feed containing the particles to be separated by flotation is prepared or conditioned with appropriate collectors and frother reagents prior to entry to the column, so that the values are hydrophobic and will be able to form strong bonds with bubbles. The feed to the column enters at the inlet 10 and flows through the pre-mixing device 11 where it mixes with air which enters at 12. In this embodiment the gas is premixed with the liquid in a plunging jet apparatus prior to introduction to a pressure reducing means. The feed liquid enters a converging section 13 forming a nozzle in which the liquid is accelerated to form a plunging jet 14 of relatively high velocity. A pressurised gas stream enters through the side arm 15, and is entrained into the high speed jet 14 to form a gas-liquid mixture in which the bubbles are typically less than 0.5 nm n in diameter, in a conduit 16. The bubbly two-phase flow travels vertically downwards to the bend 17 where it changes direction, and enters a throttling duct 18 which has the form of a converging-diverging channel. Preferably the velocity of the gas-liquid mixture in the throat of the converging-diverging channel exceeds the speed of sound, when the flow is said to be "choked". The flow becomes choked when the ratio of the absolute pressure upstream of the throat to the absolute pressure downstream of the throat exceeds a critical value. When the pressure ratio is above the critical value, the flow downstream of the throat becomes supersonic, and a shock wave forms in the diverging section, which involves a large pressure rise over a very small physical distance, of the order of 3 to 5 mm. The small bubbles in the gas-liquid mixture are rendered even smaller by being forced through the shock wave, where they are brought into intimate contact with the hydrophobic particles in the suspension to form bubble-particle aggregates. The emulsion of fine bubbles and adhering particles then passes through the connecting conduit 19 to a shroud in the form of a draft tube or riser 20, before discharging into the flotation tank or column 21. The column contains liquid whose upper surface 22 is maintained at a particular level by means not shown. The bubbles disengage from the liquid and rise through the froth-liquid interface 22, carrying the hydrophobic particles into the froth 23, which discharges over a lip 24 into a launder 25 and thence out of flotation vessel through an exit conduit 26. The liquid flows downwards to the base of the cell 21, and leaves through the exit pipe 27, and a valve 28 that is used to control the level of liquid in the cell.

Because the density of the gas-liquid mixture leaving the restrictive throat 18 is less than that of the contents of the column 21, which is essentially that of gas-free liquid, an upwards convective flow is established through the draft tube 20. Liquid from the column is drawn into the base of the draft tube and is brought into contact with bubbles that have been generated in the plunging jet contactor 16 and the choked flow device 18 in combination. Thus a proportion of the particles that may not have made contact with bubbles when first entering the vessel through the contacting system, or which may have detached from the froth layer 23 and fallen back into the liquid in the flotation vessel 21, will have an additional opportunity to become attached to bubbles and be carried by them into the froth layer. It has been found that if the draft tube 20 is open-ended at its upper and lower extremities, the ratio of the flowrate of recirculating liquid to that of the incoming feed liquid, which is termed the internal recycle ratio, is quite large, of order 4 to 6. Such flowrates give rise to highly energetic flows within the cell 21, and a buoyant plume rises from the upper open end of the draft tube 21 whose velocity is so high that it can be disruptive to the froth layer and lead to an increase in drop-back of particles from the froth. Accordingly it has been found to be advantageous to incorporate an entry tube 29, which restricts the internal recycle ratio to a value preferably between 2 and 3. The height/diameter ratio of the draft tube 20 and the inlet pipe 29 are each preferably in the range 2 to 5. The centreline of the horizontal conduit 19 should intersect with the axis of the draft tube 20 at a height approximately equal to 1.5 times the diameter of the conduit 19 above the lowest extremity of the said draft tube.

In this embodiment preferably the plunging jet contactor is mounted so that the jet is directed vertically downwards. The cross-sectional area of the plunging jet contactor 16 in a plane normal to the axis should be such that the downward superficial velocity of the liquid is above the terminal velocity of the largest bubbles that are likely to form in the contactor, and it has been found that an appropriate velocity is in the range 0.3 to 1 m/s. It is convenient to make the cross-sectional area of the inlet and outlet of the converging-diverging throttle 18 and the transfer conduit 19, to be the same as that of the contactor 16. The cross-sectional area of the draft tube 20 should be not less than that of the contactor 16, and should preferably in the range 2 to 4 times said area. The area of the entry pipe 29 should be in the range 0.1 to 0.5 of the cross-sectional area of the draft tube 20.

Figure 2:
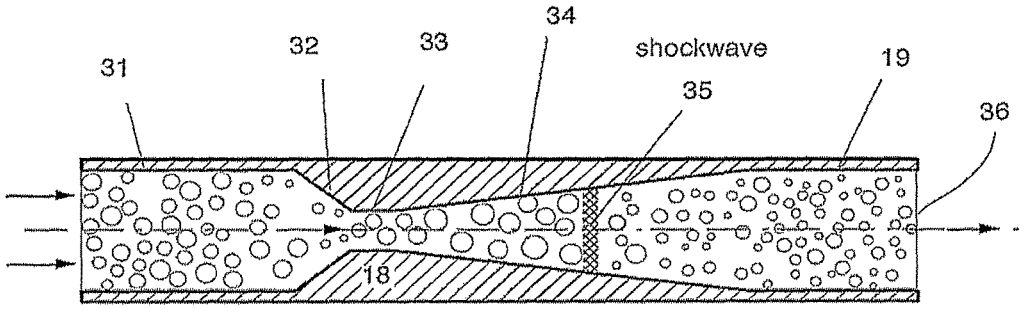
FIG. 2 is a schematic view of the flow restriction device shown in FIG. 1.

The area of the throat is chosen with advantage so that the gas-liquid mixture formed in the contactor 16 attains the speed of sound there. If the sonic velocity is exceeded, a shockwave forms downstream of the throat, which has an effect on the size of the bubbles in the flow. FIG. 2 shows a shock wave bubble generator according to the present invention in greater detail. In FIG. 2, the device 18 comprises a conduit 31, a converging section 32, a throat 33 in which the walls are essentially parallel, a relatively slowly diverging section 34 and a delivery conduit 19, the walls of which may conveniently be parallel. A gas-liquid mixture, preferably well-mixed so that the bubbles are already finely divided, enters the entry conduit 31. Preferably the velocity of the gas-liquid mixture in the region upstream of the throat is sub-sonic; the velocity of the gas-liquid mixture in the throat 33 reaches the speed of sound in the mixture at that point; a region of flow exists downstream of the throat 33 in which the gas-liquid mixture accelerates and reaches supersonic velocities; a shock wave 35 is produced in the slowly-diverging section 34; the flow reverts to a subsonic condition in the region immediately downstream of the shock wave and the velocity of the gas-liquid mixture is further reduced in the diverging region downstream of the shock wave. The mixture leaves the device at a convenient subsonic final velocity at the exit 36 to the conduit.

The way in which small bubbles are produced in the apparatus described can be explained with reference to the changes in the pressure in the two-phase mixture. In the entry region 31 the pressure is constant in the gas and liquid phases, and is denoted the "upstream pressure." When the mixture accelerates in the converging region 32, the pressure reduces according to well-known laws of fluid flow, so the bubbles in the mixture become larger. In the throat 33, at a critical value of the upstream pressure, the gas-liquid mixture reaches the speed of sound in the mixture. If the upstream pressure is sufficiently large, the fluid continues to accelerate downstream of the throat 33, and the pressure continues to fall, so that the bubbles continue to increase in volume. At a certain point in the diverging region, a shock wave 35 occurs, across which there is a catastrophic change in the flow, and the pressure rises from a small value ahead of the shock to a large value downstream. Because of the rapid pressure change, the large bubbles ahead of the shock break up in a violent fashion, to form very small bubbles, typically less than half the size of the bubbles in the flow in the entrance duct 31. It has been found that the thickness of the shock wave in the flow direction is relatively small, being in the range 3 to 5 mm typically. It will be appreciated that a purpose of this invention to bring about contact between hydrophobic particles and small bubbles. The chaotic motions that occur within the shock wave have the effect not only of breaking up the bubbles, but also of freshly creating a very large interfacial gas-liquid area in a high-energy, intensively-mixed zone within the shock wave and downstream of it. The combination of very small bubbles and high-energy mixing has the effect of bringing about instant contact between the bubbles and the hydrophobic particles.

The cross-sectional area to achieve a sonic velocity in the throat shown in FIG. 2, can be calculated from an equation that has been experimentally verified (Sandhu, N., Jameson, G. J. An experimental study of choked foam flows in a converging-diverging nozzle, International Journal of Multiphase Flow (1979), 5, 39). The equation is presented here in the form:

$$1-\left(\frac{P_3\delta_3}{P_0}\right)\frac{1}{\delta_t}-\left(\frac{P_3\delta_3}{P_0}\right)\ln\left[\left(\frac{P_3\delta_3}{P_0}\right)\frac{1}{\delta_t}\right]=\frac{1}{2}\left(\frac{P_3\delta_3}{P_0}\right)\left[1+\frac{1}{\delta_t}\right]^2 \quad (1)$$

where $P_0$ is the pressure in the conduit 31 upstream of the throat; $\delta_t$ is the gas/liquid volume ratio in the throat 33; and $\delta_3$, $P_3$ are respectively the gas/liquid volume ratio and the pressure in the discharge conduit 19. (All pressures are in units of Pascals absolute). The gas/liquid ratio in the throat $\delta_t$ can be represented as the dimensionless liquid flowrate:

$$\frac{1}{\delta_t} = \frac{Q_L / A_t}{(P_3\delta_3/\rho_L)^{0.5}}, \tag{2}$$

where $Q_L$ is the volumetric flowrate of liquid ($m^3/s$); $\rho_L$ is the density of the liquid ($kg/m^3$) and $A_t$ is the flow area in the throat 33 ($m^2$). Thus if the downstream conditions, i.e. the pressure and the gas/liquid volume ratio in the aerated mixture entering the flotation cell, are known, it is possible to solve equation 1 to find the critical value of the upstream pressure $P_0$ for the velocity in the throat 33 to reach the speed of sound and hence for the flow to be choked. Any increase in pressure above the critical value will lead to the formation of a shock wave downstream of the throat.

It is not possible to find analytic solutions to Equation 1. However, it has been found that the following equation, which can be solved easily, is an excellent representation of Equation 1 for values of the dimensionless liquid flowrate ($1/\delta_t$) less than 2.5:

$$\frac{p_0}{p_3\delta_3} = 0.5516\left(\frac{1}{\delta_t}\right)^2 + 1.655\left(\frac{1}{\delta_t}\right). \tag{3}$$

The rate of capture of particles by flotation can be enhanced by increasing the shear rate, or rate of dissipation of energy, in the vicinity of the particles and the bubbles. The shear rate is proportional to the square root of the rate of energy dissipation. In the embodiment shown in FIG. 1, the energy dissipation rate downstream of the throat 33 is high because much of the energy stored in the pressurised feed and gas entering the throat is dissipated in the shockwave 35, which is typically 3 to 5 mm in thickness. It can be calculated for example that the energy release rate in the shockwave is of the order of 20,000 kW/cubic metre of shockwave. For particle-bubble contacting purposes however it can be advantageous to release the same amount of energy into a larger volume of liquid as in the embodiment shown in FIG. 3, which provides a longer time for the particles and bubbles to come into contact. In conventional mechanical flotation machines, the energy dissipation rate is generally in the range 2 to 3 kW of power per cubic metre of liquid in the flotation cell. Contact between bubbles and particles takes place in the volume enclosed by the impeller and stator in the cell, which is typically of the order of 5 to 10 percent of the volume of the cell. Accordingly the effective dissipation rate in mechanical cells is of the order of 50 kW per cubic metre of active volume. In flotation columns, the energy dissipation rate is much less. It is an aim of the present invention to provide an active contacting environment downstream of the flow restriction in which the energy dissipation rate is at least as high as found in mechanical flotation cells. In the embodiment shown in FIG. 3, the dissipation rate in the volume immediately downstream of the throat 33 is of the order of 100 to 150 kW/m3.

Figure 3:
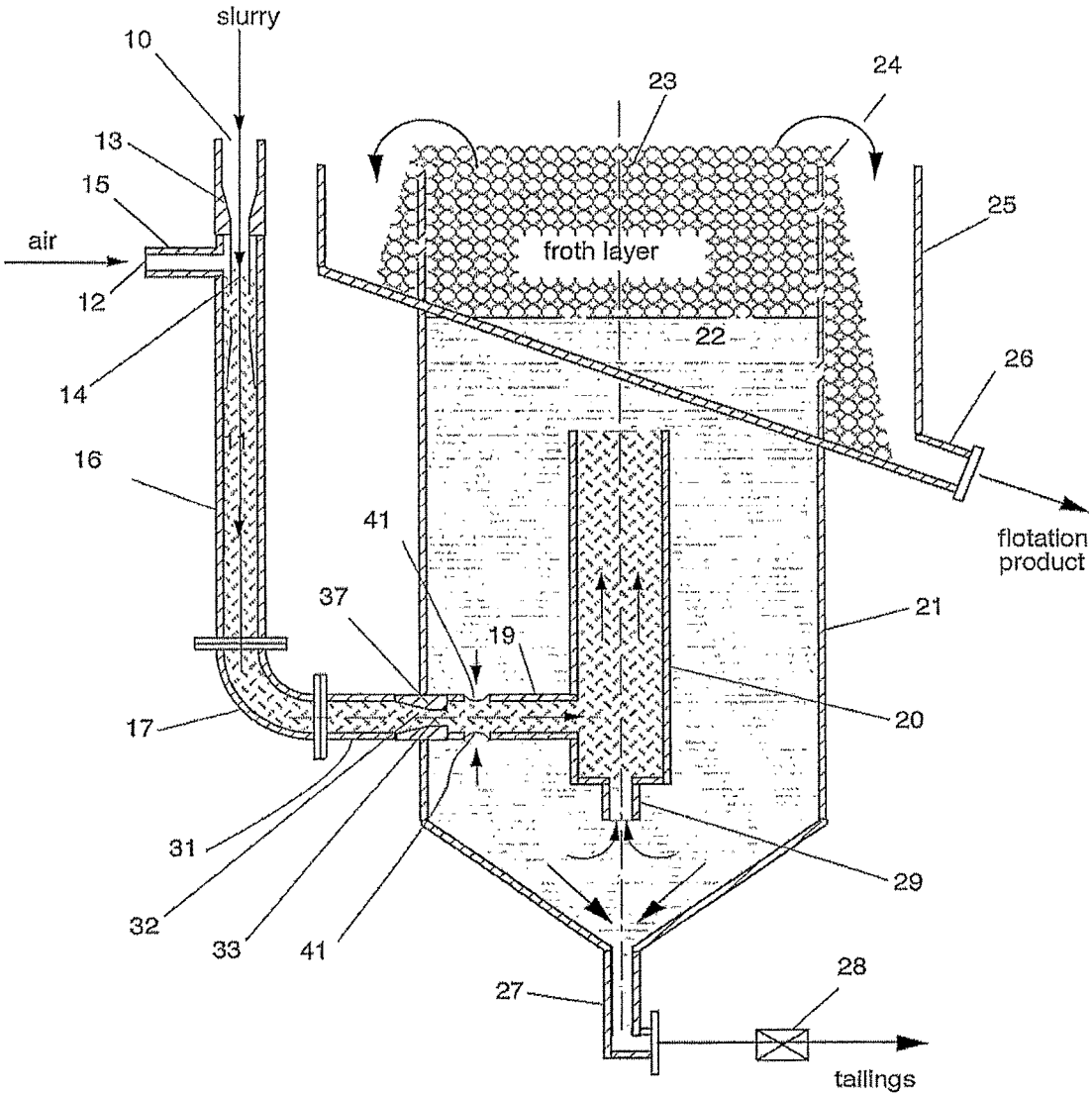
FIG. 3 is a schematic side view of the apparatus shown in FIG. 1 using an alternative flow restriction device.

The embodiment shown in FIG. 1 has the advantage that, through the use of the divergent diffuser downstream of the throat, the maximum amount of mechanical energy in the feed to the choke can be recovered, which can be an important consideration when running costs are important. However, in some cases, energy costs are outweighed by other factors, especially where it is possible to increase the recovery of valuable particles. A further embodiment is shown in FIG. 3, in which energy recovery is reduced but where the mechanical energy that is lost is used to improve the contacting between the incoming feed liquid and the liquid in the flotation column. The slowly-diverging diffuser 34 is dispensed with. The mixture of gas bubbles from the aerating contactor 11 enters through the conduit 31, and accelerates in the converging channel 32 to a throat 33 which discharges directly into a duct 19; there is no slowly-diverging diffuser 34. The short form of the constriction is denoted 37. The critical pressure for the attainment of sonic flow in the throat is predicted by equations (1) and (3) as before. If the critical pressure is exceeded, shockwaves are formed downstream of the throat, but they are not necessarily bounded by a solid wall. The flow issuing from the throat takes the form of a gas-liquid wall jet with considerable velocity, of the order of 20 m/s. The throat discharges directly into the conduit 19, in the walls of which openings 41 have been formed, through which liquid is entrained from the flotation column 21. Particles that may have escaped capture in the first pass of the feed liquid into the combined aerating contactor 11 and the restricting throat 33, have an additional opportunity to be captured by bubbles freshly entering the column through the throat 33. This embodiment is particularly favourable for the capture of ultrafine particles, because of the creation of a high-shear environment with a high gas/liquid ratio, in the mixing zone downstream of the jet issuing from the throat 33. One or more openings 41 should be provided. The openings are conveniently located equi-spaced around the circumference of the conduit 19, at a position downstream of the throat equal to 0.5 to 2 times the throat diameter. The total flow area of the openings 41 should be approximately equal to the cross-sectional area of the conduit 19.

In all the embodiments disclosed here, the throat length should preferably be in the range 0 to 3 times the throat diameter.

An advantage of using the converging-diverging nozzle shown in FIG. 2 and the truncated form shown in FIG. 3, is that high ratios of gas to feed liquid can be dispersed into small bubbles in such devices, especially when operated in choked conditions where shockwaves form downstream of the nozzle. In the case of a nozzle discharging into a flotation cell at essentially atmospheric pressure, for gas:liquid ratios of 0.5 to 4 at the same pressure, the pressure upstream of the choke is typically 1.7 to 4 times the downstream pressure, implying that the gas:liquid ratio within the contactor 16 is in the range 0.58 to 0.25. The gas:liquid ratio has a strong effect on bubble generation and generally, finer bubbles can be formed when the volume ratio of gas to liquid is small, because of the reduction in the rate of coalescence of bubbles subsequent to formation. High gas:liquid ratio dispersions of bubbles in the flotation slurry are highly desirable, because they lead to high values of the specific surface area of bubbles, which leads in turn to higher carrying capacity or production from the flotation device as a whole. Accordingly, in the embodiments described, it is convenient to operate with gas:liquid ratios in the flotation column between 0.5 and 4.

Figure 4:
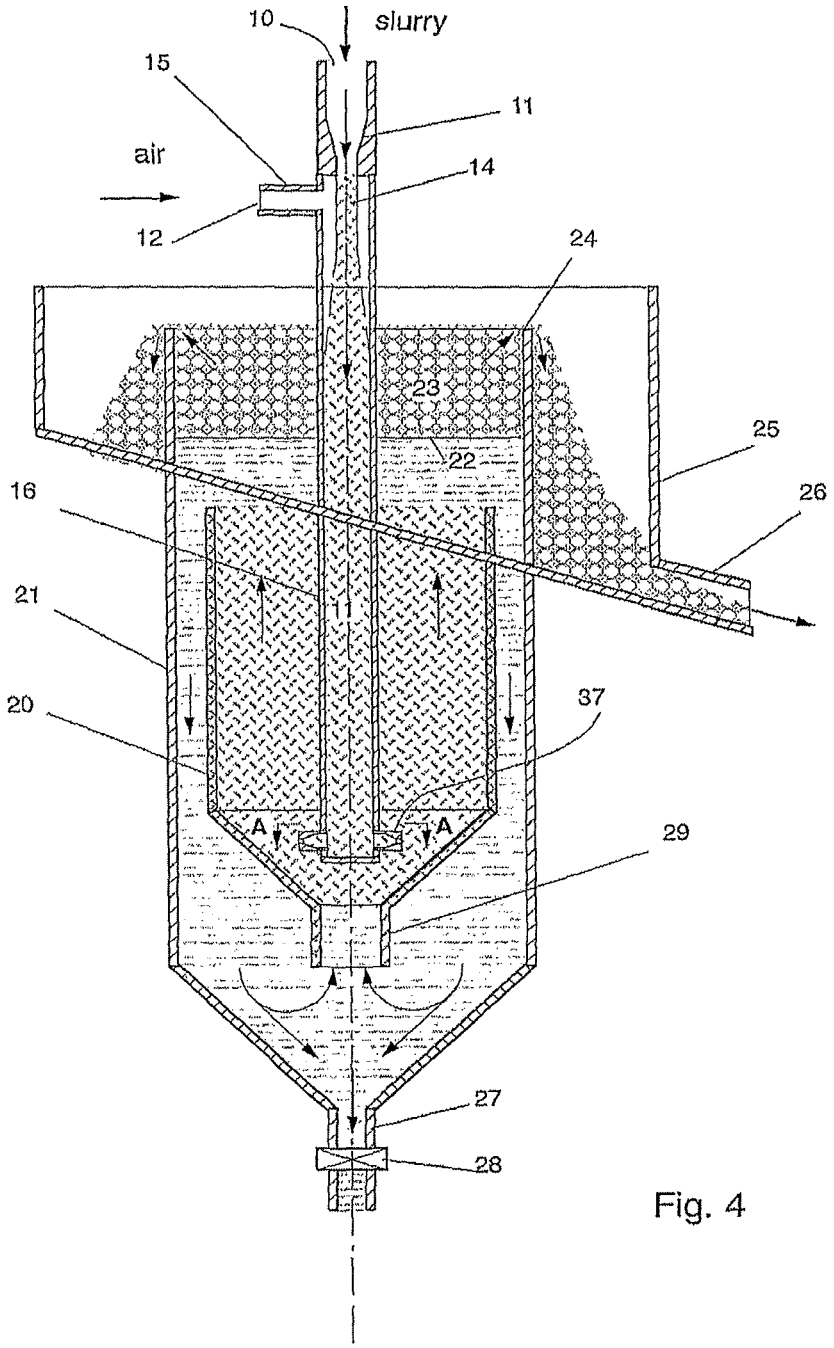
FIG. 4 is a schematic side view of an alternative gas-liquid contactor and riser pipe according to the invention.
Figure 5A:
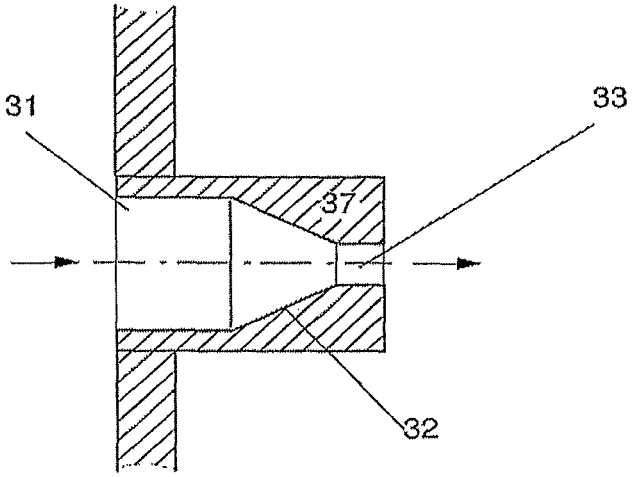
FIG. 5(*a*) is an enlarged side view of the flow restriction shown in FIG. 3 and FIG. 4.
Figure 5B:
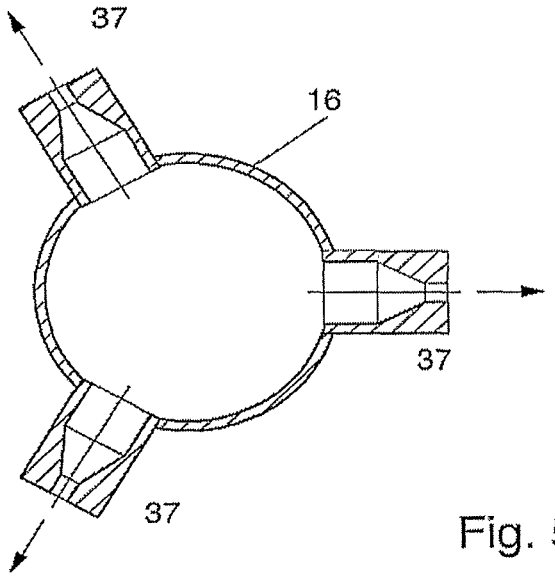

A further embodiment is shown in FIG. 4, in which the gas-liquid contactor 16 is mounted by means not shown essentially co-axially with the flotation column 21. Suitably conditioned feed liquid is introduced through the inlet pipe at 10 which has a converging section 11 in which the liquid is accelerated to form a plunging jet 14 of relatively high velocity. A gas stream under pressure enters through a side arm 15, and is entrained into the high speed jet 14 to form a gas-liquid mixture in the contactor 16 in which the bubbles are substantially less than 1 mm in diameter. The bubbly mixture travels downwards to the lower end of the downcomer, where it passes into a discharge nozzle 37 shown in more detail in FIGS. 5(*a*) and 5(*b*). Each exit nozzle 37 communicates with the liquid inside a flotation column 21. The liquid flows downwards to the base of the cell 21, and leaves through the exit pipe 27, and a valve 28 that is used to control the level of liquid in the cell. The upper lip 24 of the vessel 21 forms an overflow weir for froth 23 which is collected in a launder 25 and is drained away through an outlet 26.

In operation, the contactor 16 is filled with a dense foam that travels downwards to discharge through one or more discharge nozzles 37. The bubbles in the mixture discharged from the contactor mix with the liquid in the containing vessel 21 and disengage from it, rising to the top of the vessel to form the froth layer 23. The level of liquid in the outer vessel or container is maintained by the valve 28 or other means, at a level 22. Air is introduced through the entry port 12, at a pressure and flowrate so that the downcomer 16 fills with a dense foam that is agitated by the entering jet of liquid 14, that carries the particulate material to be collected by the bubbles. The turbulent mixing created by the kinetic energy in the plunging jet is a highly favourable environment for the capture of particles by the bubbles in the dense foam. Because of the violent and turbulent nature of the plunging jet the particles in the feed liquid are brought into intimate contact with the bubbles, thus providing a favourable environment for the collection of the hydrophobic particles by the bubbles. Because of the flow restriction brought about by the discharge nozzle 37, the pressure in the downcomer 16 is well above the ambient pressure in the containing vessel 21 at the discharge end of the nozzle 37. The small bubbles in the gas-liquid mixture are rendered even smaller by being forced through the nozzle, where they are brought into further intimate contact with the hydrophobic particles in the suspension to form bubble-particle aggregates. The pressure of the liquid feed and the air supply are such as to be able to maintain the flow of gas and liquid through the discharge nozzles 37.

The gas-liquid mixture that discharges from the shortened nozzle 37, which consists only of the converging section 37 and the parallel-walled throat 33, does so at a considerable velocity, and the momentum in the flow can be utilised further, to increase the overall efficiency of the flotation system. Thus it has been found advantageous to incorporate an internal draft tube 20, which surrounds the lower end of the contactor 16. Because the average density of the gas-liquid mixture being discharged into the draft tube is lower than the density of the liquid in the vessel 21, it tends to rise in the vertical direction, and a circulating pattern is created. Liquid from the vessel is drawn into the entry tube 29 which would otherwise be passing directly out of the tailings exit pipe 28, so the incorporation of the draft tube leads to the further exposure of the particles in the recirculated liquid to the bubbles discharging from the nozzle(s) 37, thereby leading to further opportunities for capturing some particles that would otherwise pass out of the vessel In relation to the embodiment shown in FIG. 4, FIG. 5(*a*) shows an elevation view of a discharge nozzle 37, and FIG. 5(*b*) shows a plan view of an embodiment comprising three nozzles 37 equi-spaced around the periphery of the contactor 16. It will be appreciated that one or more nozzles could be used, in which case the total flow area of the throats 33 of the individual nozzles should be used in the calculation of the upstream pressure P.sub.0 in the contactor 16.

Figure 6A:
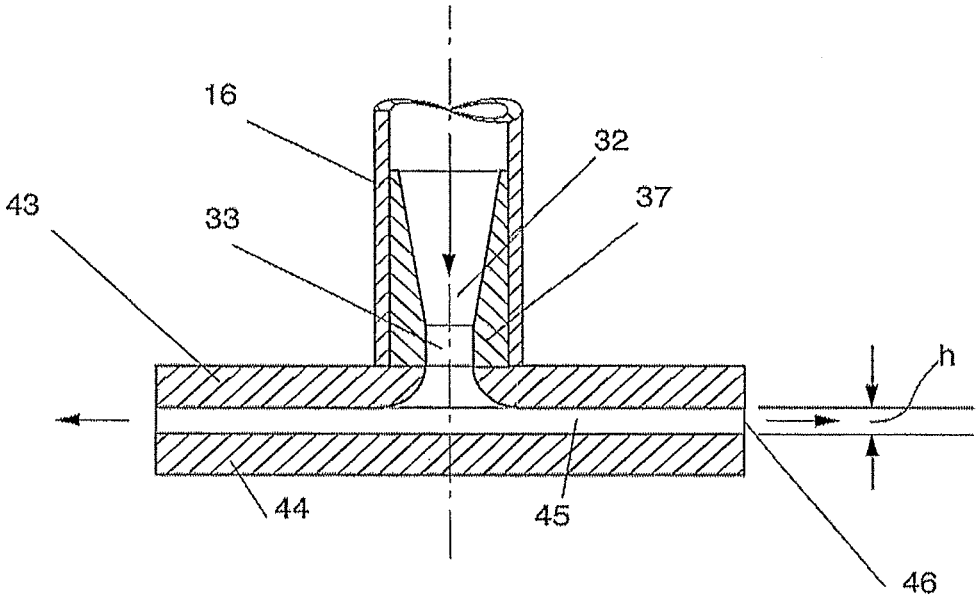
FIG. 6(*a*) is an enlarged side view of an alternative restriction at the exit from the gas-liquid contactor and directing the discharge from the restriction in the radial direction.
Figure 6B:
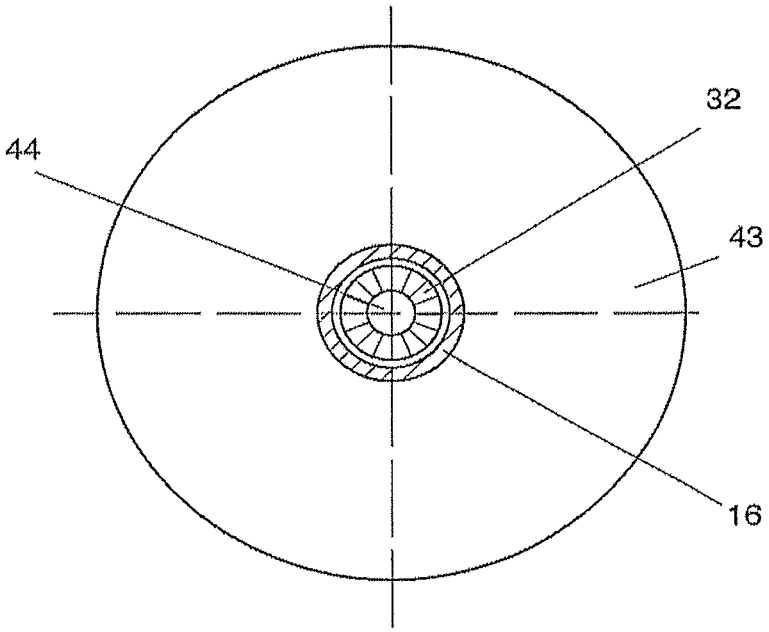

FIG. 6(*a*) shows an alternative embodiment of the pressure restriction and dispersion means for use at the termination of the initial contactor 16. A mixture of gas bubbles and liquid slurry formed in the contactor enters a converging conduit 32 of a truncated choke 37 and passes to a throat 33 from which it leaves through a radial diffuser in the space between an upper circular disc 43 and a lower circular disc 44. The discs 43, 44 that define the radial passageway of the disperser are substantially horizontal.

In the embodiment shown in FIG. 6(*a*), the two circular discs 43,44 may be held at a fixed distance apart, so that the flow passage between them is of constant vertical height. In this case, the velocity between the discs decreases continuously with increasing radial distance from the axis. If the velocity is sufficiently high, sonic flow conditions will exist in or downstream of the throat 33. Surprisingly, it has been found advantageous to mount the lower disc so that it is free to move in the vertical direction. Because of the changes in velocity within the space between the discs, the pressure in said space is substantially less than the pressure at the end of the radial channel, and hence, is less than the pressure in the liquid external to the radial disperser. A large force is thus induced that tends to push the two discs together. If the lower disc is free to move, it will come to a stable equilibrium at a certain distance from the upper disc. Observation suggests that in this case the speed of sound is reached in the gas-liquid mixture when it reaches the outermost region 46 of the radial passage between the discs.

It is a property of the converging flow in the radial channel 45, that the suction induced in said channel decreases as the separation distance h increases. This observation gives a significant practical advantage to the case where the lower disc is free to move in the vertical direction, in that if the space between the discs becomes blocked by a large particle, the pressure in the radial channel 45 will increase and will force the lower disc 44 to move away from the upper disc 43, thereby releasing the large particle which is swept away in the flow.

Figure 7:
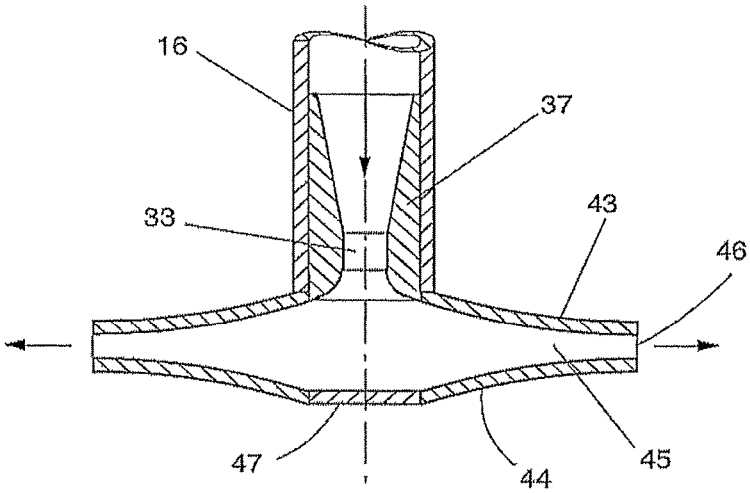
FIG. 7 is an enlarged schematic side view of the restriction and alternative radial flow device shown in FIG. 6(*a*)

In another embodiment shown in FIG. 7, upper and lower discs 43 and 44 are provided that are flexible and compliant to the flow conditions. Thus they can adapt to a shape that is dictated by the pressure developed in the flow within the radial passage 45. It has been found that in such a case, the spacing between the two circular discs at the exit 46 can be very small, leading to high velocities in the gas-liquid stream leaving the periphery of the radial disperser. The small thickness of the gas-liquid mixture at the exit is conducive to the production of very small bubbles. In such an apparatus, one or both of the opposing discs can be flexible. An impingement plate 47 is provided, to absorb the stagnation pressure of the impinging liquid jet emanating from the throat 33. It is preferred that both the converging nozzle 37 and the impingement plate 47 be of a wear-resistant substantially solid material. It is preferable for the impingement plate to be restrained by a means not shown, at a fixed distance from the throat 33, and on the same vertical axis. This embodiment is particularly useful in a feed stream containing coarse particles. Because of the flexible properties of the material used for either or both of the upper and lower discs, it is not necessary for a complete disc to move in order to release a particle that may have become lodged in the radial channel 45—all that is required is for one of the discs to distort locally, in the region of the particle, for the latter to be released, thereby unblocking the channel.

Figure 8:
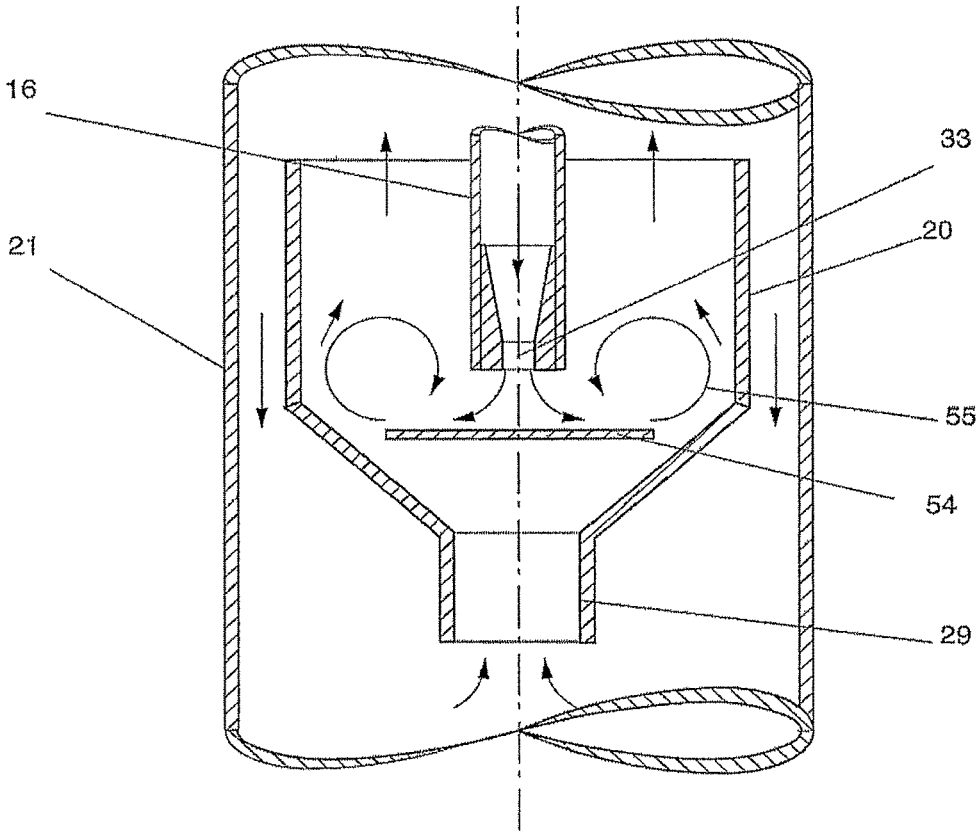
FIG. 8 shows a schematic side view of an alternative flow restrictor and apparatus to direct the downstream flow in a radial and then a vertically-upwards direction.

A further embodiment is shown in FIG. 8, which depicts a restrictive throat at the lower extremity of a first contacting device 16. The mixture of fine bubbles and slurry passes through the throat 33 under pressure, and strikes the impingement plate 54 at high velocity, spreading out in the radial direction. Because of the high momentum in the jet, liquid is entrained, and the jet expands as it travels radially outwards. The draft tube 20 restricts the outwards radial motion of the jet, and a toroidal vortex 55 is formed. The average rate of shear in the toroid is very high, and an environment that is very favourable to the break-up of bubbles and the contacting of bubbles and particles exists. Remarkably, it has been found that the gas fraction in the region surrounding the vortex can be maintained at values as high as 0.65, approaching the maximum packing fraction of spheres. The high gas fraction also leads to rapid contact of bubbles and hydrophobic particles, especially for larger particles, because the distance between bubbles is smaller than the size of the particles. Flotation efficiency is further improved by the buoyancy-induced flow created in the draft tube 20, which permits some of the liquid that has previously entered through the pressure restricting throat 33, which may contain particles that have dropped out of the froth, to be recycled.

Figure 9:
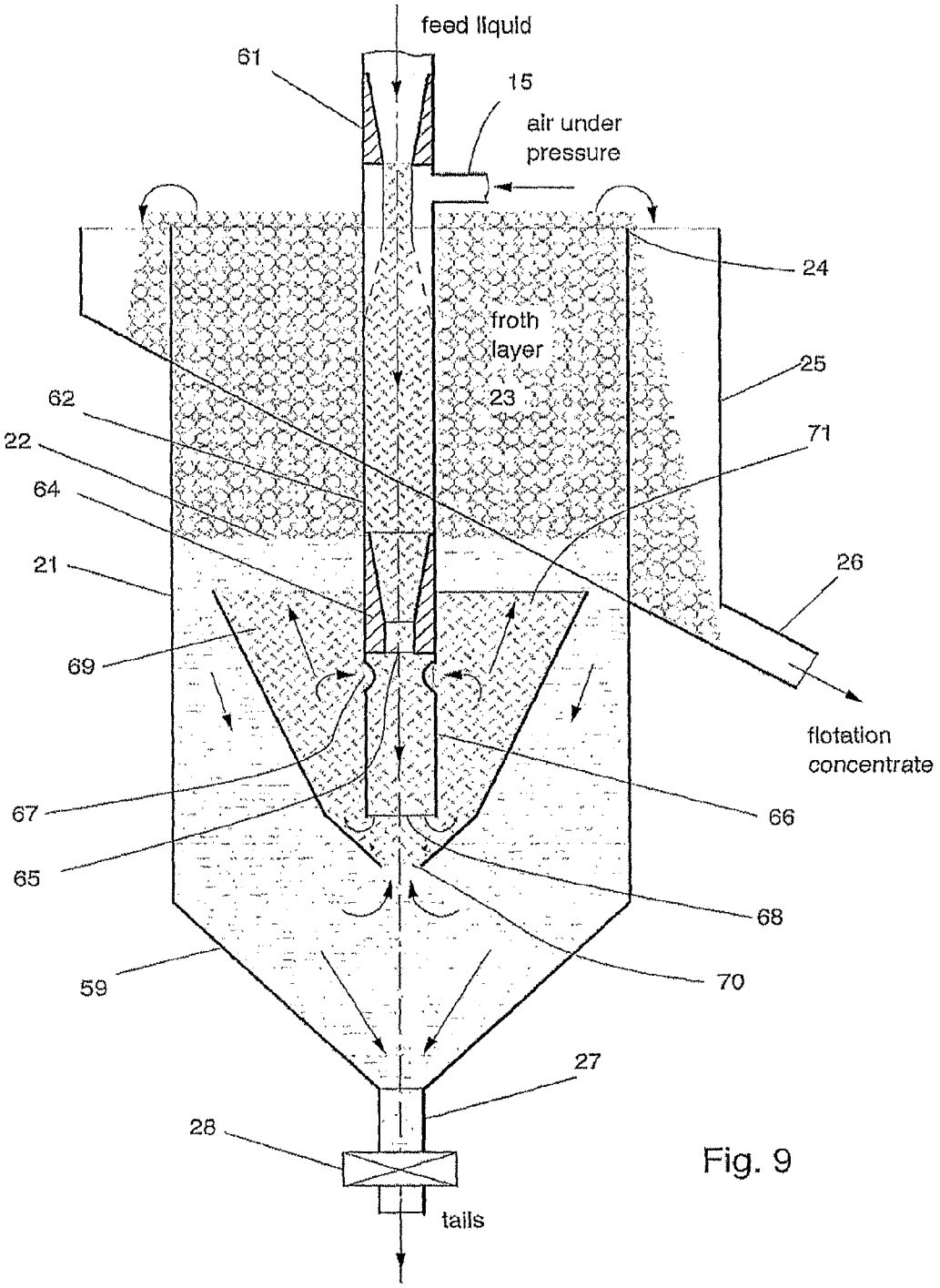
FIG. 9 shows an alternative gas-liquid contactor, pressure reducing restrictor and flow distribution means.

FIG. 9 shows a further embodiment in which the flotation device consists of a separation vessel 21 which can be conveniently cylindrical in form, with a conical bottom 59, a froth overflow lip 24 at the upper end of the cylindrical vessel, which is surrounded by a launder 25 fitted with an outlet 26 for the removal of froth product from the device. At the lower end of the separation vessel is a conduit 27 for the discharge of tailings under the control of a valve 28. The level of liquid in the vessel is maintained at a suitable level by means not shown. Liquid feed under pressure enters the separation apparatus through a nozzle 61. The feed is a suspension in water of particles to be treated by froth flotation, which have been suitably conditioned by reagents and frothers as appropriate. At the exit of the nozzle 61, the feed forms a liquid jet which enters a first chamber 62 and mixes with air that has been introduced under pressure through an entry pipe 15. Air is entrained through the turbulent mixing action of the jet, and is dispersed into small bubbles in the liquid, which travels downwards through the first chamber 62 to a second nozzle 64. In the second nozzle 64, the bubbly flow is forced under pressure to reach a velocity that is approximately equal to the speed of sound in the mixture. Under such conditions there are abrupt changes in pressure downstream of the nozzle exit 65, such that the bubbles in the flow are broken into smaller gas fragments. It is not essential that the sonic velocity of the mixture is reached in the nozzle 64; alternatively the conditions in the second nozzle are such as to provide a positive backpressure in the first chamber 62, and reliance is placed on the shearing action of the jet that issues from the second nozzle 65 to break up the bubbles within it as it mixes with the downstream fluid.

The exit stream from the second nozzle enters a second chamber 66, which is fitted with appropriately-placed ports 67, through which fluid can be drawn, to dilute the liquid content in the jet emanating from the second nozzle 64. The combined flow of gas-liquid mixture from the nozzle 64, and recirculating flow through the entry ports 67, passes downwards through the second chamber 66, to discharge through the opening 68.

Surrounding the second chamber 66 and co-axial with it is a draft tube 69 that is conveniently of conical shape. The combined flow leaving the second chamber 66 contains both gas and liquid, and accordingly is of lower mean density than the liquid in the flotation vessel 21, so it rises under gravity in the annular space between the chamber 66 and the draft tube 69, filling the said annular space with a bubbly mixture. Liquid from the lower part of the separation vessel 21 is drawn through the port 70 at the lower extremity of the draft tube 69.

The two-phase gas-liquid mixture rising out of the open upper end 71 of the draft tube enters the upper part of the separation vessel 21, and the gas bubbles rise upwards and separate from the liquid to form a froth layer 23. The froth rises upwards and discharges over the lip 24 into the launder 25 and out of the vessel through the exit pipe 26. The tailings, from which the floatable material has substantially been removed, pass out through the pipe 27. This embodiment is particularly appropriate for the recovery of coarse particles, because the conical draft tube 69 can be of such dimensions and placed in such a way that distance between the top of the said draft tube and the froth-liquid interface 22 can be minimised. The tapered shape of the conical draft tube permits the upward velocity of the mixture of liquid and particle-laden bubbles to diminish with height generating a quiescent flow leaving the upper exit of the draft tube 69, thereby enhancing the probability of retention of coarse particles by the bubbles.

Figure 10:
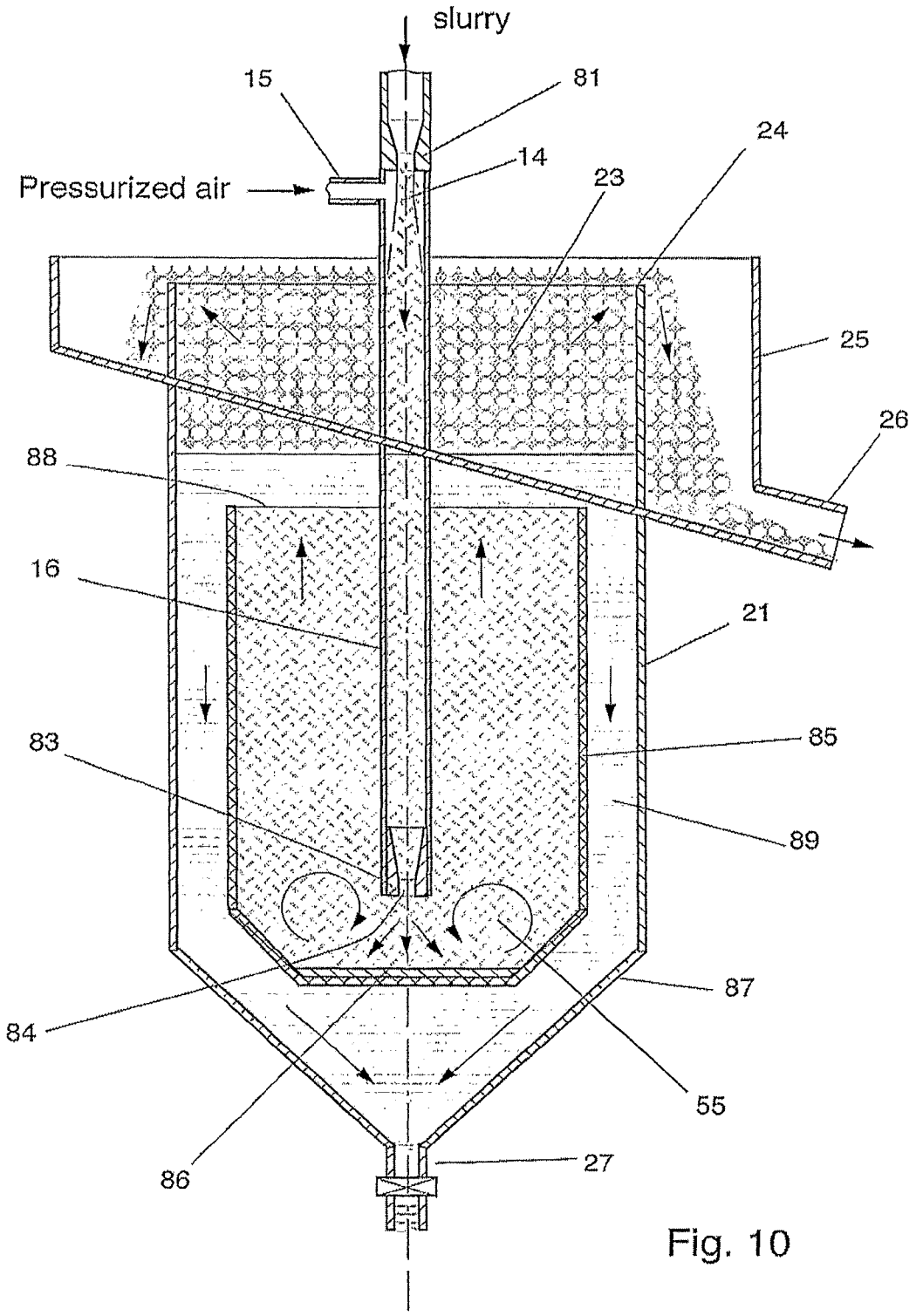
FIG. 10 shows a further alternative gas-liquid contactor and pressure-reducing means and conduit to direct the resulting gas-liquid mixture to the froth layer in a flotation column.

A further embodiment is shown in FIG. 10 in which pressurised aerated slurry from a first chamber discharges into a second contacting chamber as a high-speed jet, of velocity typically in the range 10 to 20 m/s. The contents of the base of the second chamber are vigorously agitated by the energy in the jet providing an environment that is particularly favourable for further reducing the size of the bubbles and for capturing hydrophobic particles in the feed. The gas fraction in the lower parts of the second chamber may be as high as 0.5 to 0.6, values that are typical of a dense liquid foam, and particularly useful for capturing coarse particles. The height of the second chamber is such that when the gas-liquid mixture nears the top, the flow is relatively quiescent. The bubbles continue to rise into the froth layer, while the waste particles are carried out of the vessel. Particles that drop back from the froth fall directly into the second chamber under gravity where they have an additional opportunity to attach to fresh rising bubbles.

In the embodiment shown in FIG. 10, liquid feed under pressure enters the separation apparatus through a nozzle 81. The feed is a suspension in water of particles to be treated by froth flotation, which have been suitably conditioned by reagents and frothers as appropriate. At the exit of the nozzle 81, the feed forms a liquid jet 14 which enters a first chamber 16 and mixes with air that has been introduced under pressure through an entry pipe 15. Air is entrained through the turbulent mixing action of the jet, and is dispersed into small bubbles in the liquid, which travels downwards through the first chamber 16 to a second nozzle 83, from which it issues under pressure through the throat 84. Bubbles that have been formed in the first chamber 16 are further reduced in size by the pressure changes as they pass through the nozzle 83, and by the high-shear environment downstream of the nozzle. The exit stream from the second nozzle enters a second chamber 85, which is conveniently cylindrical in shape, and of a diameter much larger than that of the first chamber 16. The high-speed gas-liquid jet that issues from the nozzle 83 is directed downwards against an impingement plate 86 that is constructed of a high-wear material, and is deflected so as to flow radially outwards to the conical base 87 of the second chamber. In the base of the second chamber, the gas-liquid mixture is highly agitated by the energy in the incoming jet, and forms a rapidly-rotating toroidal vortex 55, in which the size of the bubbles is reduced by the high-shear conditions, which are also favourable to high rates of contact between bubbles and particles in the liquid. As the mixture rises, the general level of turbulence reduces and the flow at the top of the second chamber 85 is relatively uniform.

The two-phase gas-liquid mixture rising out of the open upper end 88 of the second chamber 85 enters the upper part of the separation vessel 21, and the gas bubbles rise upwards and separate from the liquid to form a froth layer 23. The froth rises upwards and discharges over the lip 24 into the launder 25 and out of the vessel through the exit pipe 26. The tailings, from which the floatable material has substantially been removed, pass out through the pipe 27.

It is advantageous to be able to control the liquid velocity rising in the riser conduit that forms the second chamber 85, especially when the particles are so large that their terminal velocity is greater than the liquid vertical velocity in the riser. In the embodiments shown in FIGS. 8 and 9, it is difficult precisely to control the velocity in the draft tube, which is a function not only of the gas fraction in the feed fluid but also the solids fraction in the feed and in the liquid external to the draft tube. In the embodiment shown in FIG. 10, the riser has a closed base, and the superficial rise velocity of the liquid across the exit plane 88 is related simply to the liquid flowrate through the throat 84 and the cross-sectional area perpendicular to the flow at 88. The feed does not contain individual particles at infinite dilution. In practice, the feed consists of a suspension of particles at a finite volume fraction, and hence the terminal velocity of individual particles is less than the terminal velocity at infinite dilution because of the phenomenon known as hindered settling. Thus it is not necessary for the vertical velocity in the riser 85 to exceed the terminal velocity of individual particles, in order for such particles to be carried upwards and out of the riser; all that is required is to maintain a velocity that exceeds the hindered settling velocity, so that the suspension forms an expanded fluidised bed. Accordingly, in the present embodiment the device should be sized to maintain the hydrophobic and hydrophilic particles in the feed in a suspended state in the second chamber 85. The hydrophobic particles attached to bubbles will rise out of the liquid and into the froth layer, while other particles will flow with the liquid down the annular gap 89 between the column 21 and the outer wall of the second chamber 85. In practice it is found that some of the coarse hydrophobic particles that are carried into the froth, subsequently disengage from bubbles and drop back into the vessel 21, as a result of bubble coalescence in the froth. In the embodiment shown in FIG. 10, the majority of such particles will fall back into the second chamber 85 where they will be captured by bubbles newly entering the system, and carried once more into the froth.

The invention is described in terms applicable to the separation of minerals in which ore is finely crushed to form a slurry or suspension of particles in water, and the slurry is conditioned with collector and frother to make the mineral species that is to be recovered by flotation hydrophobic or non-wetting, while the non-wetting or hydrophilic species that are to remain in the suspension and are discharged from the flotation vessel as tailings. An example of this is the separation of fine coal particles from the surrounding gangue in a mining operation.

However the invention will also apply to systems in which the particles are of an organic native and typically of biological or non-metallic origin such as algae, printing ink, dairy fat or other liquid particulate systems. The invention will also apply to systems in which all the particles are to be removed in the froth, there being no requirement to separate the components of the particles in the feed liquid on the basis of their hydrophobicity or lack thereof.

A further application is in the removal of metals such as aluminium from suspensions.

EXAMPLE

Samples of silica were subjected to flotation in an embodiment of the invention according to FIG. 1. The silica had a top size of 48 microns and half of the particles in the sample by mass had a particle size below 7.9 microns. Dodecylamine was used as collector at 500 gm/tonne, and methyl isobutyl carbinol at a concentration of 20 ppm was used as frother. The silica, at a concentration of 5% W/W was conditioned in a feed tank for ten minutes, before being pumped to the gas-liquid contactor. In two separate runs the volume ratios of the air flowrate to the flowrate of feed in the flotation column were 1:1 and 2:1 respectively. The pressures upstream of the choking nozzle are shown in Table 1. The overall recovery was calculated from measurements of the flowrates of the feed, the product and the tailings, and the percent solids in each flow. To correct for the presence of entrained material in the concentrate, the amount of entrainment was estimated on the assumption that the water in the froth product contained silica at the same concentration as in the tailings. Tests were conducted with a device constructed according to the present invention and also for comparison, an existing technology in the form of a conventional Jameson cell was used. The results are shown in Table 1.

TABLE 1

| Flotation machine | Air:feed volumetric ratio | Pressure upstream of constriction, kPa gauge | Overall recovery % | True recovery % |
|---|---|---|---|---|
| This invention | 1:1 | 90 | 77 | 74 |
| | 2:1 | 150 | 93 | 87 |
| Existing technology | 1:1 | — | 54 | 51 |

Figure 11:
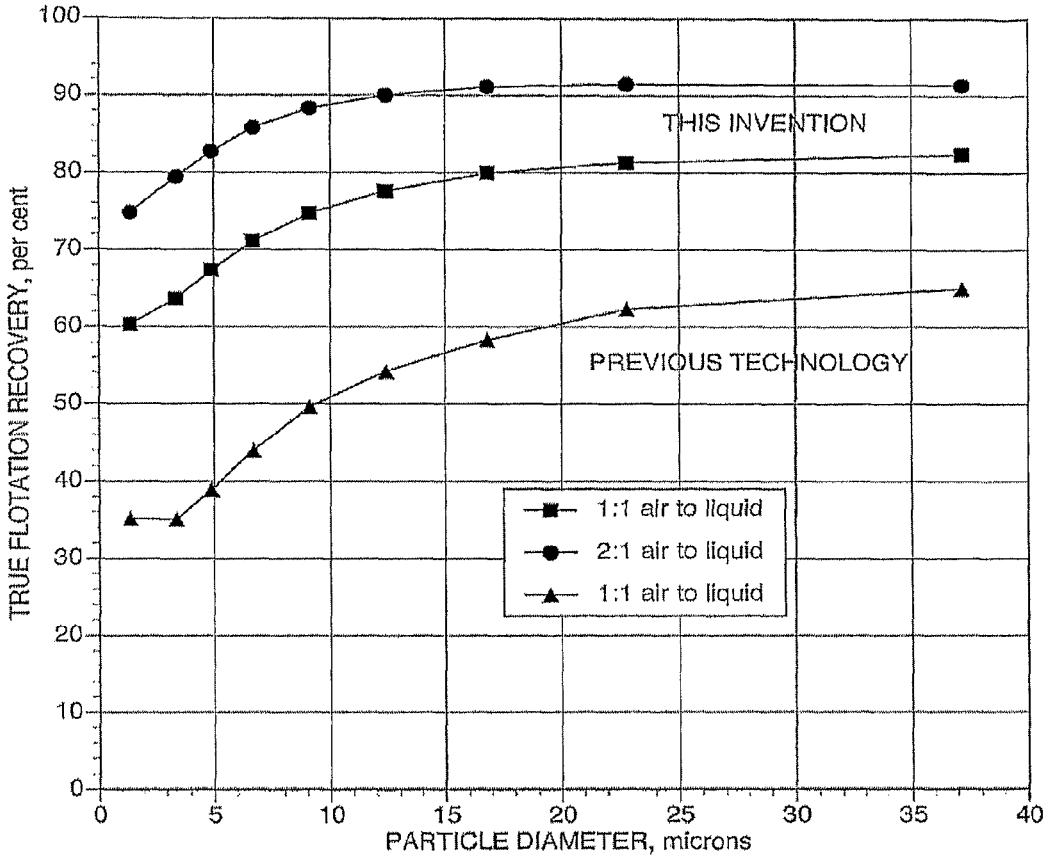
FIG. 11 shows the recovery of particles of various sizes subjected to flotation in a device according to the invention.

The true recoveries were also calculated on a size-by-size basis, and the results are shown in FIG. 11.

What is claimed is:

1. Apparatus for contacting bubbles and particles in a flotation separation system, said apparatus comprising:

a contactor arranged to receive under pressure a supply of feed slurry incorporating particles suspended in a liquid and a supply of gas, the contactor being arranged to mix the slurry with the gas forming a gas-liquid bubbly two-phase mixture;

an outlet from the contactor configured to provide a restriction to the flow of mixture therethrough and maintain the mixture within the contactor under pressure, the outlet further being configured to induce a supersonic shockwave within the mixture passing therethrough, and configured such that when slurry and gas are fed into the contactor at feed rates and pressures determined to form said gas-liquid bubbly two- phase mixture and force the mixture through the outlet at a rate that induces said supersonic shockwave within the mixture reducing the size of the bubbles within the mixture and bringing those bubbles into intimate contact with particles in the mixture; and a separation cell arranged to receive mixture from the outlet, impinging the mixture against adjacent surfaces to create a high shear environment for the mixture before allowing bubbles with attached particles to rise to the surface of liquid within the cell.

2. Apparatus for as claimed in claim 1, wherein the separation cell is provided with a mixture-directing device arranged to receive the mixture from the outlet and control the release of that mixture into the cell.

3. Apparatus as claimed in claim 1 wherein the contactor comprises a substantially vertical column arranged to receive the feed slurry under pressure into the top of the column.

4. Apparatus as claimed in claim 3 wherein the container incorporates mixing means comprising a nozzle arranged to form a downwardly plunging jet of feed slurry within the column, and a gas inlet in the vicinity of the jet so formed such that in use gas is entrained into the jet forming said gas-liquid bubbly two-phase mixture.

5. Apparatus as claimed in claim 3 wherein the outlet from the contactor is configured to form at least one throttling duct providing said restriction to the flow of mixture therethrough.

6. Apparatus as claimed in claim 5 wherein the throttling duct has a converging section leading to a throat sized to provide said restriction.

7. Apparatus as claimed in claim 5 wherein the column is located with its lower end within the separation cell, and wherein the throttling duct is orientated substantially downwardly at the lower end of the column and provided with an impingement plate positioned substantially horizontally below the throttling duct, spaced therefrom so as to provide the outlet inducing said supersonic shockwave within the mixture passing therethrough.

8. Apparatus as claimed in claim 7 wherein the impingement plate comprises a lower circular disc aligned with and spaced from an upper circular disc having a central hole therethrough arranged to receive mixture issuing from the throttling duct, such that in combination with the diameter of the discs and the operating pressure and velocity within the throttling duct, sonic flow conditions exist in use in or downstream of the throat in the throttling duct, and wherein the lower disc is spaced a fixed distance from the upper disc, said distance being determined to provide said sonic flow conditions.

9. Apparatus as claimed in claim 8 wherein the lower disc is free to move in a vertical direction relative to the upper disc, allowing the lower disc to come to a stable equilibrium in use, forming said sonic flow conditions.

10. Apparatus as claimed in claim 8 wherein the lower disc is flexible and able to adapt to a shape dictated by pressure developed in the flow between the discs in use, and wherein the lower disc is provided with a central solid wear resistant zone located a fixed distance below the outlet from the throttling duct.

11. A method of contacting bubbles and particles in a flotation separation system, said method comprising the steps of:

providing apparatus including:

a contactor arranged to receive under pressure a supply of feed slurry incorporating particles suspended in a liquid and a supply of gas, mixing means within the contactor arranged to mix the slurry with the air forming a gas-liquid bubbly two-phase mixture, an outlet from the contactor configured to provide a restriction to the flow of mixture therethrough and maintain the mixture within the contactor under pressure, a flow manipulator downstream from the outlet configured to induce a high energy dissipation rate within the mixture passing therethrough, and a separation cell arranged to receive mixture from the flow manipulator and allow bubbles with attached particles to rise to the surface of liquid within the cell; and feeding slurry and gas into the contactor at feed rates and pressures determined to form said gas-liquid bubbly two-phase mixture and force the mixture through said flow manipulator at a rate that induces said high energy dissipation rate within the mixture reducing the size of the bubbles within the mixture and bringing those bubbles into intimate contact with particles in the mixture.

12. A method as claimed in claim 11 comprising the step of feeding the mixture from the flow manipulator into a mixture directing device within the separation cell in a manner that, in combination with the shape of the mixture directing device, reduces turbulence within the mixture.

13. A method as claimed in claim 12 wherein the mixture directing device is a draft tube in the form of a substantially vertical shroud arranged to direct the flow of mixture upwardly into the separation cell.

* * * * *